US006736906B2

(12) United States Patent
Cotte et al.

(10) Patent No.: US 6,736,906 B2
(45) Date of Patent: May 18, 2004

(54) TURBINE PART MOUNT FOR SUPERCRITICAL FLUID PROCESSOR

(75) Inventors: John M. Cotte, New Fairfield, CT (US); Matteo Flotta, Central Valley, NY (US); Kenneth J. McCullough, Fishkill, NY (US); Wayne M. Moreau, Wappingers Falls, NY (US); Keith R. Pope, Danbury, CT (US); John P. Simons, Wappingers Falls, NY (US); Charles J. Taft, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 174 days.

(21) Appl. No.: 10/120,309

(22) Filed: Apr. 10, 2002

(65) Prior Publication Data

US 2003/0192575 A1 Oct. 16, 2003

(51) Int. Cl.[7] ..... B08B 3/00; B08B 3/10

(52) U.S. Cl. ..... 134/33; 134/137; 134/140; 134/157; 134/163; 366/273

(58) Field of Search ..... 134/33, 34, 42, 134/137, 140, 147, 157, 163; 366/273, 279

(56) References Cited

U.S. PATENT DOCUMENTS 556,604 A * 3/1896 Willie ..... 134/163
1,049,896 A * 1/1913 Miller ..... 134/162
5,474,877 A 12/1995 Suzuki ..... 430/325
6,001,418 A 12/1999 DeSimone et al. ..... 427/240
6,277,753 B1 8/2001 Mullee et al. ..... 438/692
6,401,734 B1 * 6/2002 Morita et al. ..... 134/153

OTHER PUBLICATIONS

"Mechanism of Resist Pattern Collapse during Development Process", Toshihiko Takana et al., Jul. 7, 1993, Jpn. J. Appl. Phys. vol. 32 (1993) pp. 6059–6064.

"Semiconductor Lithography" Wayne M. Moreau, Jan. 1988, Chapters 10 and 11.

* cited by examiner

*Primary Examiner*—Frankie L. Stinson
*Assistant Examiner*—Saeed Chaudhry
(74) *Attorney, Agent, or Firm*—Daniel P. Morris; Perman & Green, LLP

(57) ABSTRACT

A workpiece holder for processing a workpiece in a chamber of a liquified fluid. In one embodiment, the workpiece holder includes a cylindrically shaped rotator having an exterior wall and at least one fluid guide on the exterior wall. The rotator is adapted to rotate and provide fluid flow across a first end of the rotator, and is adapted to provide fluid flow and mixing perpendicular to a surface of the first end of the rotator. A fixture is coupled to the first end of the rotator for securing the workpiece to the first end of the rotator.

28 Claims, 4 Drawing Sheets

TURBINE PART MOUNT FOR SUPERCRITICAL FLUID PROCESSOR

BACKGROUND OF THE INVENTION

1. Field of the Invention

The present invention relates to workpiece mounting devices and, more particularly, to a device for mounting workpieces that facilitates their treatment by a fluid mixture.

2. Brief Description of Related Developments

Designs for treating workpieces, such as for example, wafers or parts to be cleaned, in a fluid mixture generally use active stirring mechanisms physically separate from the workpiece mounting. In thin film processing, cleaning and other processes, it is generally desirable to have flow directed axially with respect to the surface of the workpiece.

In the process of fabricating a semiconductor device, a predetermined pattern is transferred to or drawn on a resist film covering the surface of a semiconductor substrate. The fabrication process uses water and aqueous bases for developing or rinsing the created photoresist pattern, and rinsing off strippers and slurries. The remaining surface liquid, such as water, can cause a collapse of the resist pattern during the evaporation of the surface liquid. This image collapse is due to the high surface tension of the surface liquid.

In order to reduce image collapse, liquified, or supercritical, carbon dioxide ($SCCO_2$) having a very low surface tension is mixed with the surface liquid remaining on the semiconductor device to remove the surface liquid from the semiconductor device. As carbon dioxide is not very soluble in water, an additional emulsifying agent, or agents, can be added to the liquified carbon dioxide to aid in inducing a low surface tension in the water. The additional agent needs to be mixed with the liquified carbon dioxide, or the combination of the liquified carbon dioxide and the agent, must be mixed with the surface water. While some mixing methods have been used to stir the liquified fluid with the surface liquid, image collapse due to the high surface tension is still a problem. In addition, reducing image collapse is becoming more important as semiconductor devices become larger with more complex resist patterns, and the resist patterns are including patterns of lines and spaces which are decreasing in size.

It would be advantageous to be able to facilitate the processing of semiconductor devices with a liquified fluid mixture and provide fluid agitation for mixing and directed flow into a single part.

SUMMARY OF THE INVENTION

The present invention is directed to a workpiece holder for processing a workpiece in a chamber of a liquified fluid. In one embodiment, the workpiece holder includes a cylindrically shaped rotator having an exterior wall and at least one fluid guide on the exterior wall. The rotator is adapted to rotate and provide fluid flow across a first end of the rotator, and is adapted to provide fluid flow and mixing perpendicular to a surface of the first end of the rotator. A fixture is coupled to the first end of the rotator for securing the workpiece to the first end of the rotator.

In one aspect, the present invention is directed to a method of processing a workpiece in a chamber of liquified fluid. In one embodiment, the method includes providing a workpiece holder including a cylindrically shaped rotator having an exterior wall and at least one fluid guide on the exterior wall, the rotator adapted to rotate and provide fluid flow across a first end of the rotator. The step of providing the workpiece holder also includes a fixture coupled to the first end of the rotator for securing the workpiece to the first end of the rotator. The method further includes securing the workpiece to the first end of the cylindrically shaped rotator with the fixture, and rotating the workpiece holder, wherein the at least one fluid guide mixes and agitates the liquified fluid and directs the liquified fluid perpendicular to a surface of the first end of the rotator to remove surface fluid from the workpiece and preventing image collapse of the workpiece.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
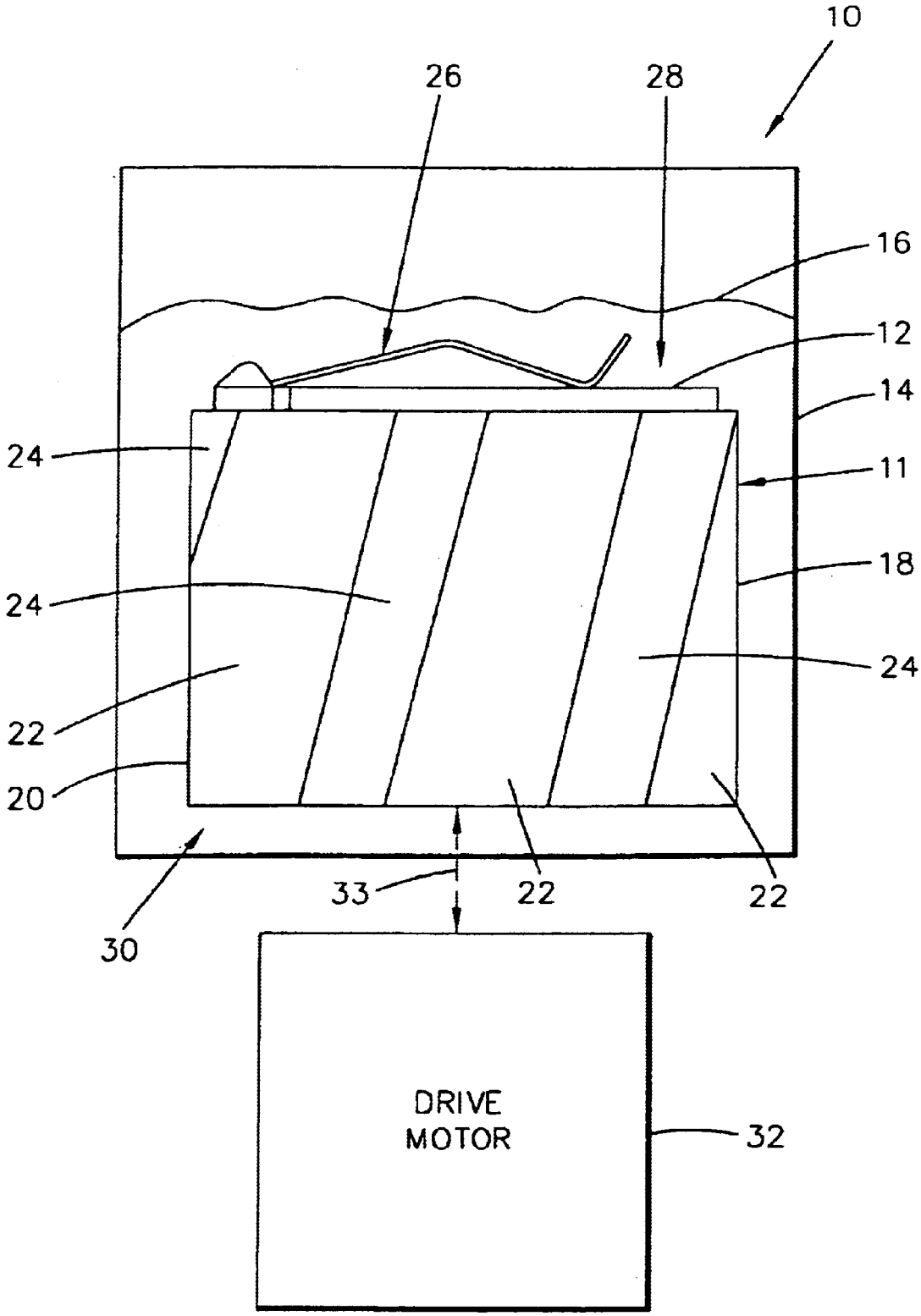
FIG. 1 is a plan view of an embodiment of a workpiece holder incorporating features of the present invention.

Referring to FIG. 1, there is shown a plan view of a system 10 incorporating features of the present invention. Although the present invention will be described with reference to the embodiment shown in the drawings, it should be understood that the present invention can be embodied in many alternate forms of embodiments. In addition, any suitable size, shape or type of elements or materials could be used.

As shown in FIG. 1, the system 10 generally comprises a workpiece holder 11 for processing a workpiece 12 in a chamber 14 of liquified fluid 16. The workpiece holder 11 includes a rotator 18 having an exterior wall 20 with at least one fluid guide 22. The fluid guide 22 can comprise a turbine blade 22 machined from the exterior wall 20 of the workpiece holder 11. In one embodiment, the fluid guide can be formed by creating channels 24 in the exterior wall 20. A fixture 26 is coupled to the rotator 18 for securing the workpiece 12 to an end of the rotator 18, such as the top end 28.

As shown in FIG. 1, a drive motor 32 is located outside the chamber 14. The drive motor 32 is used to rotate the rotator 18. In one embodiment as shown in FIG. 1, the drive motor 32 can be magnetically coupled to the rotator 18. In alternate embodiments, the drive motor 32 can be coupled to the rotator 18 in any suitable fashion, such as for example, a drive shaft. The drive motor 32 includes a magnetic device (not shown) located outside of the chamber 14 that allows the drive shaft to be coupled to the magnetic characteristics of the workpiece holder 14 and rotate the rotator 18. The rotator 18 can be rotated at approximately 450 RPM (rotations per minute), although faster and slower rotation speeds can also mix the liquified fluid with the remaining fluid on the surface of the workpiece 12 for facilitating removal of the surface fluid.

While a drive motor 32 located outside the chamber 14 has been described and shown, the present invention is not so limited, as the drive motor 32 may be part of the chamber 14 or located wherever the drive motor 32 can rotate the workpiece holder 11 without interfering with fluid flow in the chamber 14, without departing from the broader aspects of the present invention. Moreover, while a magnetic device in a drive motor 32 has been described, the present invention is not so limited, as any device or process which generates a sufficient magnetic field to securely couple to the rotator 18, and which can cause rotation at a sufficient speed, can be used as a drive motor 32, without departing from the broader aspects of the present invention.

Figure 3:
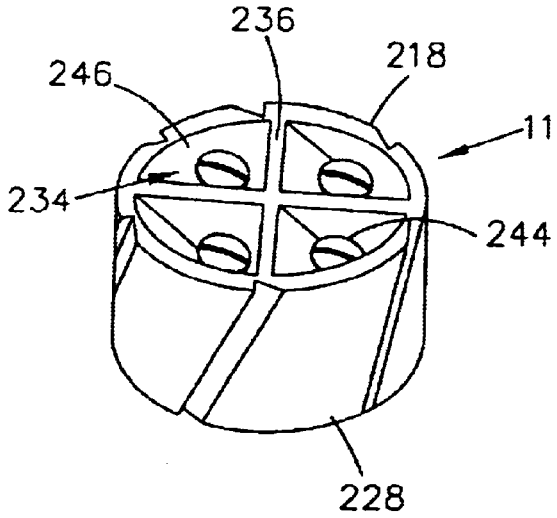
FIG. 3 is a perspective bottom diagonal view of an embodiment of a workpiece holder incorporating features of the present invention.
Figure 2:
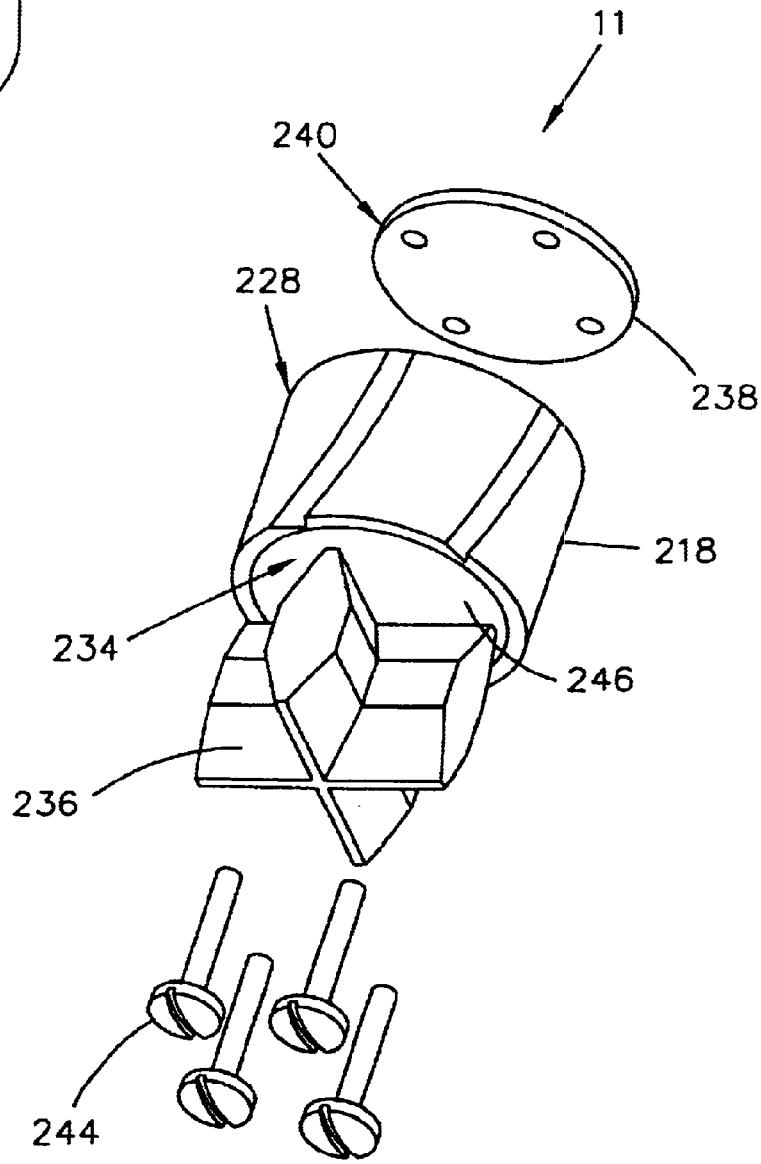
FIG. 2 is an exploded perspective view of an embodiment of a workpiece holder incorporating features of the present invention.

Referring to FIGS. 2 and 3, in one embodiment, a rotator 218 can comprise a cylindrically-shaped shell with an interior aperture 234. While a rotator 18 having a cylindrically shaped shell has been shown and described, in alternate embodiments, the rotator can have a solid form incorporating the sample holder surface without departing from the broader aspects of the present invention. The rotator 18 can have magnetic characteristics for coupling to the magnet of the drive motor 32. For example, a magnetic device 236, such as a symmetrical cross shaped magnet 236, can be secured in the interior aperture 234 of the rotator 218. In an alternate embodiment, the rotator 18 can be a solid object with a magnet coupled to the bottom end 30 of the rotator 18.

The magnet 236 is adapted to provide the rotator 218 with the magnetic characteristics for coupling the rotator 218 to the drive motor 32 and rotating the rotator 18. The magnet 236 can be secured to the rotator 218 with screws 244. In alternate embodiments, the magnet 236 can be secured in any suitable fashion other than including screws. While a cross shape for a magnet 236 has been shown, the magnet 236 can be any shape which turns concentrically about the axis of the rotator 18.

Continuing with FIGS. 2 and 3, the screws 244 can be inserted into a sample holder 238 which can be inserted into the top end 228 of the rotator 218. The sample holder 238 generally provides a surface area 240 on the top end of the rotator 218. An interior wall 246 of the rotator 218 can have a flange (not shown) for supporting the sample holder 238.

Continuing with FIGS. 2 and 3, the rotator 218, sample holder 238, magnet 236 and screws 244 can be made of stainless steel, although any other suitable material can be used without departing from the broader aspects of the present invention. In addition, the rotator 218 and the magnet 236 can be coated with, for example, PTFE (Teflon™) to reduce friction characteristics of the rotator 218 and magnet 236 for facilitating the rotation of the rotator 218.

Figure 4:
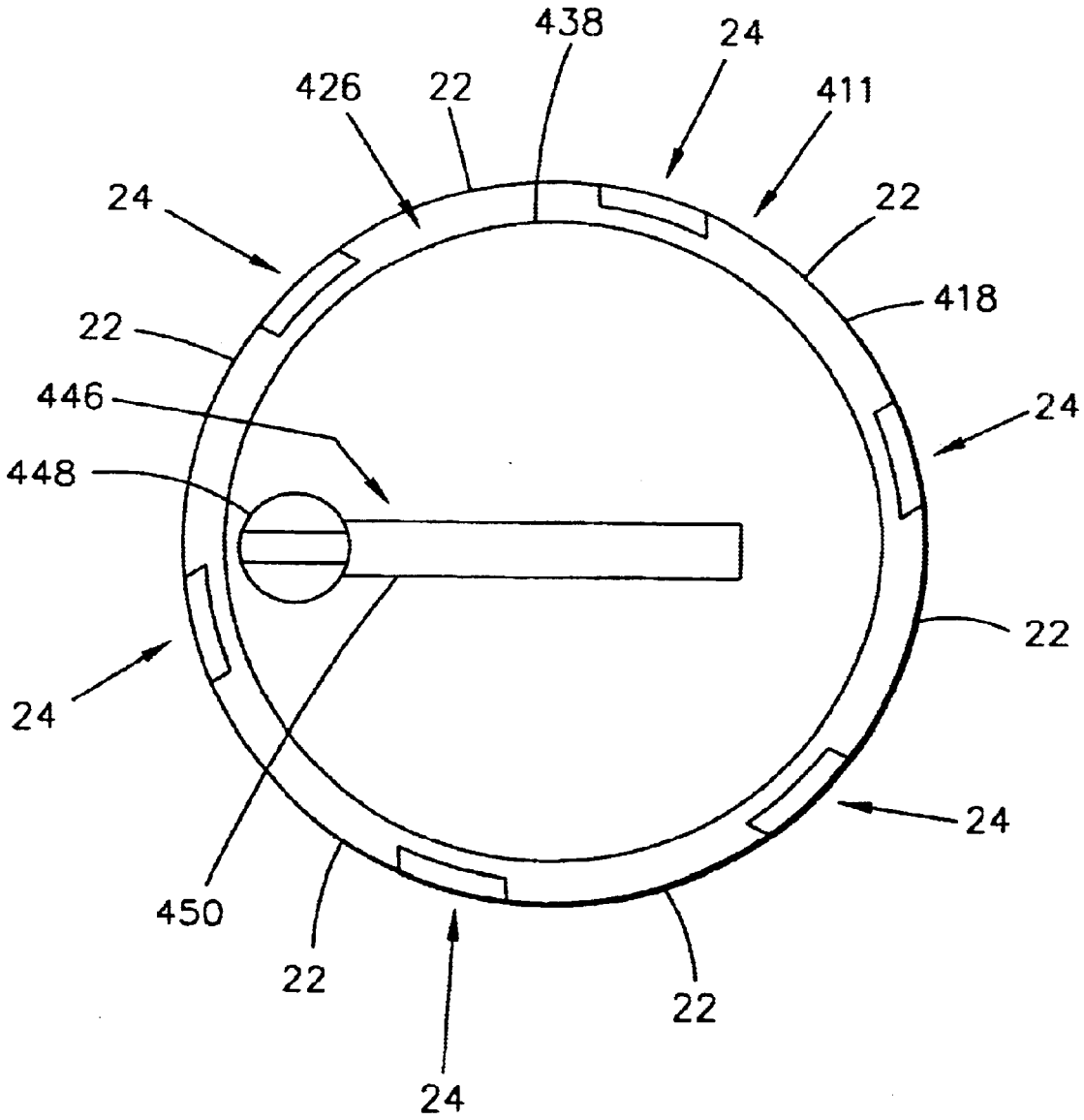
FIG. 4 is a top plan view of an embodiment of a workpiece holder incorporating features of the present invention.

Referring to FIGS. 1 and 4, a fixture 426 can be coupled to a sample holder 438 for securing the workpiece 12 to the top end of the rotator 418. The fixture 426 can include a clamp 446 including a clamp screw 448 for securing a retaining device 450 to the sample holder 438. Other apparatus for securing a workpiece 12 to the workpiece holder 411, such as a locking ring or a vacuum device, can also be used without departing from the broader aspects of the present invention.

As shown in FIGS. 1 and 4, the turbine blades 22 are set at an angle to the axis of the cylindrically-shaped rotator. While a particular angle has been shown, the angle can vary without departing from the broader aspects of the present invention. In addition, while the turbine blades 22 are shown extending from one end of the rotator 18 to the other end of the rotator 18, the present invention is not so limited. In alternate embodiments, the turbine blades 22 can begin partially up the rotator and extend to the top end 28 of the rotator, without departing from the broader aspects of the present invention.

While FIGS. 1 and 4 show the turbine blades 22 having straight edges, the present invention is not so limited, as the turbine blades 22 can have curved edges without departing from the broader aspects of the present invention. Furthermore, while a rotator 18 having fluid guides which are machined from the rotator has been shown and described, the present invention is not so limited. In alternate embodiments, the fluid guides 22 can include at least one vane or blade coupled, or otherwise attached, to the exterior wall 20 of the rotator 18 without departing from the broader aspects of the present invention.

Referring to FIG. 1, the workpiece 12 can be a wafer, such as a patterned exposed photoresist coated semiconductor wafer, having a relatively flat top surface. The workpiece 12 may also be any other shape with a flat top surface, or can include other non flat workpieces which can be secured to the workpiece holder 11. The diameter of the workpiece holder 11 can be adjusted to accommodate the size of the workpiece 12 for processing with the liquified fluid 16, and the size of the workpiece holder 11 can be adjusted to the size of the chamber 14. In addition, the workpiece holder 11 is not limited to a single workpiece 12 secured on the sample holder. In alternate embodiments, multiple workpieces 12 can be secured to the rotator 18 without departing from the broader aspects of the present invention.

Continuing with FIG. 1, the liquified fluid 16 can include supercritical carbon dioxide. In alternate embodiments, the liquified fluid can also include other adjuvants, such as surface active agents which can form a ternary mutual micelle with water and carbon dioxide. The other adjuvants can be co-solvents, such as for example, xylene or fluorocarbon. The co-solvents can be used to extract the surface water for the resist by inducing a condition of low surface tension of less than 1 d/cm. In one embodiment, the liquified fluid 16 can generally fill the chamber 14.

As shown in FIG. 1, the chamber 14 can be a high pressure reactor, which can be pressurized to about 3000 PSI (pounds per square inch). The chamber 14 can also be unpressurized or pressurized to higher and lower pressures, such as 6000 PSI, without departing from the broader aspects of the present invention. The chamber 14 can be generally circular in shape around the rotator 18. In one embodiment, the diameter of the chamber 14 surrounding, or partially surrounding, the rotator 18 can closely match the diameter of the rotator 18. In alternate embodiments, the diameter of the chamber 14 surrounding, or partially surrounding, the rotator 18 can be irrelevant to the diameter of the rotator 18, as long as sufficient clearance is provided to allow the rotator 18 to rotate and direct the liquified fluid 16. In a further embodiment, the chamber 14 can contain more than one workpiece holder 11.

Figure 5:
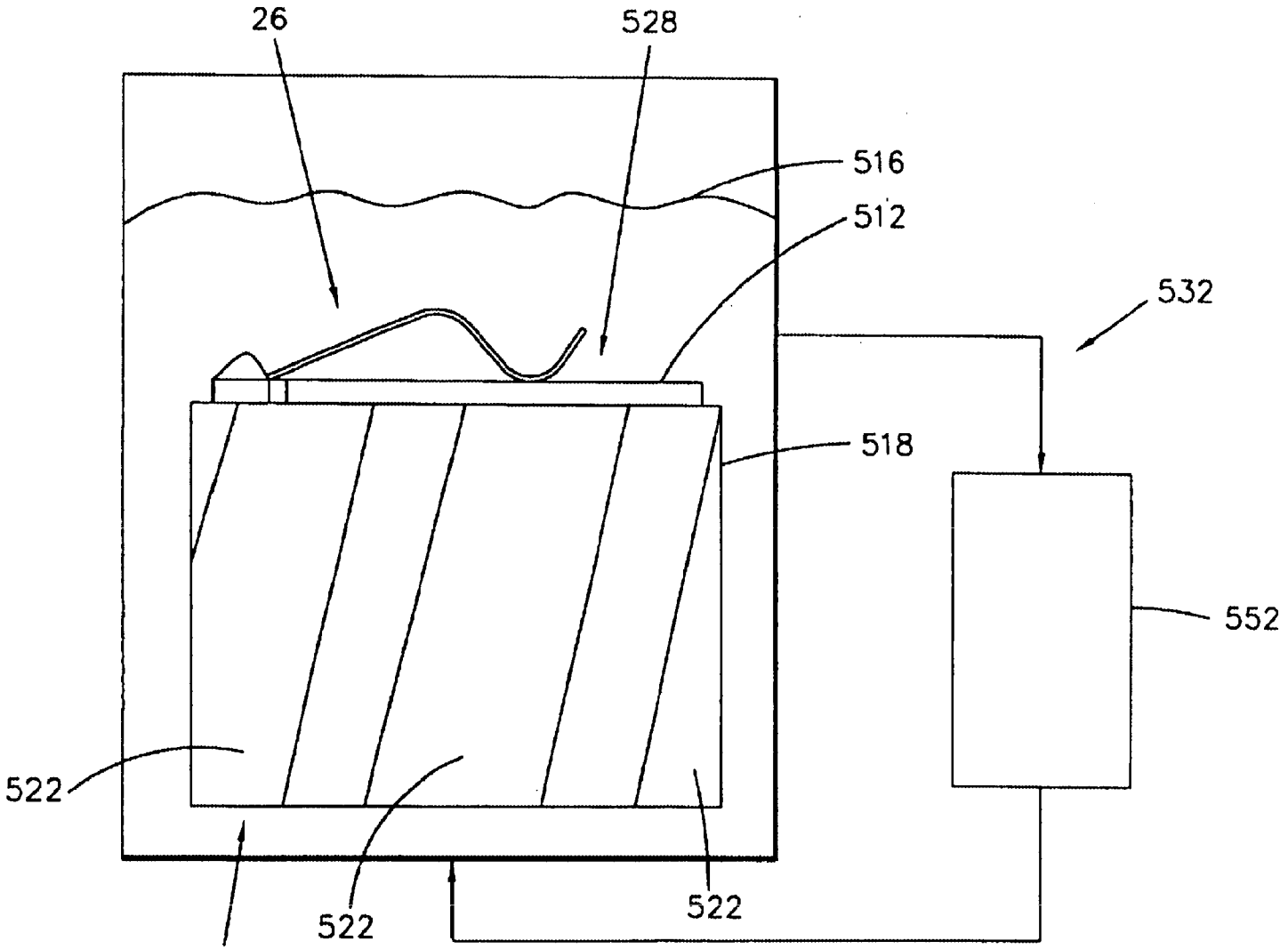
FIG. 5 is a plan view of an embodiment of a workpiece holder incorporating features of the present invention.

As shown in FIG. 5, another embodiment of the present invention includes a fluid flow driver 532 for rotating the rotator 518. The fluid flow driver 532 includes apparatus 552 for inserting liquified fluid 516 at the bottom end 530 of the rotator 518. The flow of the liquified fluid 516 from the bottom end 530 of the rotator 518 to the top end 528 of the rotator 518 exerts force on the fluid guide 522 and rotate the rotator 518 within the chamber 514 of liquified fluid 516. The rotation directs the liquified fluid 516 perpendicular to the top end 528 of the rotator 518 and across the workpiece 512. While the fluid flow driver 532 and magnetic drive motor 32 have been shown and described, the present invention is not so limited, as any method of rotating the workpiece holder 11 without interfering with the liquified fluid flow can be used without departing from the broader aspects of the present invention.

Referring to FIG. 1, in operation, the workpiece 12, such as a wafer 12, is affixed to the rotator 18, and the rotator 18 is placed inside the high pressure process chamber 14. The chamber 14 is filled with liquified fluids 16, such as supercritical carbon dioxide, and the workpiece 12 is simultaneously rotated inside the chamber 14.

Continuing with FIG. 1, the rotator 18 rotates and directs the liquified fluid 16 from the bottom end 30 of the rotator 18 to the top end 28 of the rotator 18. The rotation causes a centrifugal process which agitates and mixes the liquified fluid 16 with surface fluid, such as water, latent developer and solvent, remaining on the workpiece 12 from the fabrication process. The centrifugal process directs the liquified fluid 16 across and away from the workpiece 12, removing more of the remaining surface fluid from the workpiece 12.

The liquified fluid 16 is also mixed and directed perpendicular to the surface of the top end 28 of the rotator 18, resulting in further mixing of the liquified fluid 16 with the remaining surface fluid on the workpiece 12. The mixing lowers the surface tension of the remaining surface fluid, which speeds up the removal of the remaining surface fluid from the workpiece 12, reducing image collapse. The use of the workpiece holder 11 is at least twice as effective in preventing occurrences of image collapse as previous methods of removing surface fluid from a workpiece 12.

In a comparison showing the improvement provided by the workpiece holder 11 of the present invention, a wafer coated with positive KRS photoresist (See U.S. Pat. No. 6,001,418, herein incorporated by reference) with a thickness of 0.8 micrometer was coated on a silicon wafer. The wafer was exposed by a 25 KV electron beam to a pattern of 150 nanometer lines with adjacent 300 nanometer spaces. The exposed wafer was developed in 0.263 N TMAH, rinsed with water and kept wet and placed in the high pressure process chamber. The wafer piece was held horizontally on a flat chuck (that is, no vanes or blades) and the flat chuck was rotated with an external magnet while the process chamber was filled with supercritical $CO_2$. After processing and opening to atmosphere, the image features show collapse.

In contrast, a similar wafer coated with KRS photoresist was processed in an identical manner, except that the wafer piece was affixed to the workpiece holder 11. After identical processing and rotating with the workpiece holder 11, the image features showed no collapse.

The workpiece holder 11 is particularly advantageous for thin film processing, cleaning, and other processes where it is desirable to have a liquified fluid flow directed axially with respect to the surface of the workpiece 12 to be cleaned. For example, an application of the workpiece holder 11 can include removing water from the surface of a developed but wet rinsed resist 12 to prevent image collapse. The use of the workpiece holder 11 can remove or reduce surface water remaining on the workpiece to less than a 10 um thick layer which facilitates solubilization by the liquified fluid, such as liquified $CO_2$ and/or an emulsifying agent or co-solvent. The less water present on the workpiece surface the easier it is to remove the water.

Furthermore, the workpiece holder 11 combines two features of a reactor, directed flow and fluid agitation for mixing, into a single part. Moreover, the rotator 18 can be scaled to 300 mm workpieces 12, such as wafers. The workpiece holder 11 can also improve the cleaning of the surface of a wafer with supercritical fluids by providing centrifugal transport of removed particulates from the workpiece 12 as the surface is cleaned, and providing fresh supercritical fluids, such as a cleaning agent, at the surface of the workpiece 12.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A workpiece holder for processing a workpiece in a chamber of a liquified fluid, comprising:

a cylindrically shaped rotator having an exterior wall and at least one fluid guide on the exterior wall, the rotator adapted to rotate and provide fluid flow across a top end of the rotator, and adapted to provide fluid flow and mixing perpendicular to a surface of the top end of the rotator; and a fixture coupled to the top end of the rotator for securing the workpiece to the top end of the rotator.

2. A workpiece holder of claim 1, wherein the at least one fluid guide is at least one blade defined by the exterior wall, the at least one blade adapted to direct fluid flow against the workpiece.

3. A workpiece holder of claim 2, wherein the at least one blade extends from a bottom end of the rotator to the top end of the rotator, the at least one blade adapted to transport the liquified fluid from the bottom end of the rotator to the top end of the rotator.

4. A workpiece holder of claim 2, wherein the at least one blade is set at an angle relative to an axis of the rotator.

5. A workpiece holder of claim 2, wherein the at least one blade is a plurality of blades distributed equidistantly around a circumference of the rotator.

6. A workpiece holder of claim 2, wherein the at least one blade is at least one turbine blade.

7. A workpiece holder of claim 2, wherein the at least one blade is machined from the exterior wall.

8. A workpiece holder of claim 1, wherein the at least one fluid guide is at least one blade coupled to the exterior wall, the at least one blade adapted to direct fluid flow against the workpiece.

9. A workpiece holder of claim 1, wherein the cylindrically shaped rotator is a cylindrically shaped shell.

10. A workpiece holder of claim 1, wherein the cylindrically shaped rotator is coated with PTFE for reducing friction characteristics of the rotator for facilitating spin.

11. A workpiece holder of claim 1, wherein the fixture comprises:

a sample holder coupled across the top end of the rotator for receiving the workpiece;

a retaining device coupled to the sample holder for securing the workpiece to the sample holder.

12. A workpiece holder of claim 11, wherein the retaining device is one of a clamp, locking ring, and a vacuum device.

13. A workpiece holder of claim 11, wherein the diameter of the sample holder is adjusted to accommodate the size of the workpiece.

14. A workpiece holder of claim 1, wherein the rotator includes a magnetic device adapted for magnetically coupling the rotator to a driving mechanism.

15. A workpiece holder of claim 14, wherein the magnetic device is secured inside the rotator.

16. A system for processing a workpiece in a chamber of liquified fluid, comprising:

a workpiece holder including a cylindrically shaped rotator having an exterior wall and at least one fluid guide on the exterior wall, the rotator adapted to rotate and provide fluid flow across a top end of the rotator, and adapted to provide fluid flow and mixing perpendicular to a surface of the top end of the rotator, a fixture coupled to the top end of the rotator for securing the workpiece to the top end of the rotator;

a chamber for holding the workpiece holder and the liquified fluid for processing the workpiece; and a drive mechanism coupled to the workpiece holder for rotating the workpiece holder for directing fluid flow and agitating the liquified fluid.

17. A system of claim 16, wherein the drive mechanism is external to the interior of the pressurized chamber.

18. A system of claim 16, wherein the drive mechanism is adapted to magnetically couple to the workpiece holder.

19. A system of claim 16, wherein the rotator includes a magnetic device adapted for magnetically coupling the rotator to the drive mechanism.

20. A system of claim 16, wherein the drive mechanism comprises a fluid flow driver for inserting liquified fluid at a bottom end of the rotator, wherein flow of the liquified fluid from the bottom end of the rotator to the top end of the rotator is adapted to exert force on the at least one fluid guide and rotate the rotator within the chamber of liquified fluid for directing the liquified fluid perpendicular to the workpiece and across the workpiece.

21. A system of claim 16, wherein the workpiece is a patterned exposed photoresist coated semiconductor wafer that is to be developed in liquified fluid.

22. A system of claim 16, wherein the chamber of the liquified fluid is a high pressure process chamber.

23. A system of claim 22, wherein the high pressure process chamber is adapted to be pressurized to approximately 3000 PSI.

24. A system of claim 16, wherein the liquified fluid includes supercritical carbon dioxide.

25. A system of claim 16, wherein the rotator is adapted to rotate at approximately 450 RPM.

26. A method of processing a workpiece in a chamber of liquified fluid, comprising the steps of:

providing a workpiece holder including, a cylindrically shaped rotator having an exterior wall and at least one fluid guide on the exterior wall, the rotator adapted to rotate and provide fluid flow across a top end of the rotator, a fixture coupled to the top end of the rotator for securing the workpiece to the top end of the rotator;

securing the workpiece to the top end of the cylindrically shaped rotator with the fixture;

rotating the workpiece holder, wherein the at least one fluid guide mixes and agitates the liquified fluid and directs the liquified fluid perpendicular to a surface of the top end of the rotator to remove surface fluid from the workpiece for preventing image collapse of the workpiece.

27. The method of claim 26, wherein the step of rotating the workpiece holder generates centrifugal processing of the workpiece.

28. The method of claim 26, wherein the step of rotating the workpiece holder removes latent developer and solvent from the workpiece.

* * * * *